US008435049B2

(12) United States Patent
Uchida et al.

(10) Patent No.: US 8,435,049 B2
(45) Date of Patent: May 7, 2013

(54) ELECTRICAL CONNECTION BOX

(75) Inventors: Kunihiro Uchida, Yokkaichi (JP); Yoshihisa Shimada, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 56 days.

(21) Appl. No.: 13/232,496

(22) Filed: Sep. 14, 2011

(65) Prior Publication Data

US 2012/0202367 A1 Aug. 9, 2012

(30) Foreign Application Priority Data

Feb. 8, 2011 (JP) ..... 2011-024896

(51) Int. Cl.
*H01R 12/00* (2006.01)

(52) U.S. Cl.
USPC ..... 439/76.1

(58) Field of Classification Search ..... 439/76.1, 439/76.2, 79, 80
See application file for complete search history.

(56) References Cited

U.S. PATENT DOCUMENTS

| | | | | |
|---|---|---|---|---|
| 7,687,715 | B2 | 3/2010 | Sano | |
| 7,983,024 | B2 * | 7/2011 | Harris, IV | 361/629 |
| 2003/0157821 | A1 * | 8/2003 | Onizuka et al. | 439/188 |
| 2008/0139018 | A1 * | 6/2008 | Egawa et al. | 439/76.2 |
| 2010/0163302 | A1 * | 7/2010 | Hashikura et al. | 174/520 |
| 2011/0043969 | A1 * | 2/2011 | Shiraiwa et al. | 361/624 |

FOREIGN PATENT DOCUMENTS

| | | |
|---|---|---|
| JP | A-2009-26464 | 2/2009 |

* cited by examiner

*Primary Examiner* — Tulsidas C Patel
*Assistant Examiner* — Phuongchi Nguyen
(74) *Attorney, Agent, or Firm* — Oliff & Berridge, PLC

(57) ABSTRACT

A permanent part attachment portion and an additional part attachment portion are provided to a case. A terminal portion of a permanent bus bar is disposed in the permanent part attachment portion, and a terminal portion of an additional bus bar is disposed in the additional part attachment portion by allowing the additional bus bar to be contained in the case in a removable manner. It thus becomes possible to provide an electrical connection box that is adaptable to an addition of an electrical part without changing a die used to mold the case and/or a die used to form the bus bars.

7 Claims, 10 Drawing Sheets

ELECTRICAL CONNECTION BOX

CROSS-REFERENCE TO RELATED APPLICATIONS

This application claims priority to Japanese Application No. 2011-024896 filed in Japan on Feb. 8, 2011, the disclosure of which is incorporated herein by reference in its entirety.

BACKGROUND

The present invention relates to an electrical connection box that may be incorporated into an automobile or the like, and more particularly, to an electrical connection box in which a bus bar is contained in a case and a terminal portion of the bus bar is disposed in an electrical part attachment portion.

An electrical connection box, such as a junction box, has been employed in an automobile or the like to efficiently distribute a power supply from a battery to respective electrical components. As is described, for example, in JP-A-2009-26464, such an electrical connection box includes a plurality of electrical part attachment portions, such as fuse attachment portions and connector attachment portions, provided to a case. By disposing terminal portions of a bus bar contained in the case inside the electrical part attachment portions, it becomes possible to connect electrical parts such as fuses and connectors to the bus bar.

Incidentally, the number of electrical parts attached to the electrical connection box may vary with a specification change of an automobile. For example, in a case where a new electrical component is additionally attached, it is necessary to add a new fuse to the electrical connection box to prevent excess current from flowing to this electrical component.

With an electrical connection box in the related art, however, when a need to add an electrical part arises, such as when a fuse has to be added, it becomes necessary to provide a new part attachment portion to the case, or add a bus bar, or change a bus bar. Hence, the electrical connection box in the related art has problems in that, when such a change is made, die modification costs are incurred and man-hours for modification are required.

SUMMARY

The invention was devised in view of the foregoing. At least some embodiments of the invention have an object of providing an electrical connection box that is adaptable to an addition of an electrical part without having to change a die that is used to mold the electrical connection box.

An electrical connection box according to embodiments that incorporate a first aspect of the invention includes a case, electrical part attachment portions provided to the case, and bus bars contained in the case and having terminal portions disposed in the electrical part attachment portions. The electrical part attachment portions include a permanent part attachment portion and an additional part attachment portion, and the bus bars include permanent bus bars and an additional bus bar. The terminal portions of the permanent bus bars are disposed in the permanent part attachment portion, and the terminal portion of the additional bus bar is disposed in the additional part attachment portion. The additional bus bar is allowed to be contained in the case in a removable manner. The permanent bus bars form a complete electrical circuit when an electrical part is installed in the permanent part attachment portion, and the additional bus bar forms an additional circuit when an electrical part is installed in the additional part attachment portion.

The electrical connection box configured as above includes the case preliminarily provided with the additional part attachment portion in addition to the permanent part attachment portion and the permanent bus bar, and the additional bus bar is combined with the additional part attachment portion in a removable manner. Owing to this configuration, in a case in which it becomes necessary to add an electrical part, the electrical part can be attached to the additional part attachment portion by forming an additional circuit by combining the additional bus bar with the additional part attachment portion. It thus becomes possible to attach the additional electrical part to the electrical connection box without changing a shape of the case or a shape of the bus bars. Hence, the electrical connection box configuration becomes adaptable to an addition of an electrical part without changing a die used to mold the case and the bus bars. In a case where no additional electric part is necessary, waste of a bus bar can be reduced by providing the electrical connection box in a state in which the additional bus bar is removed therefrom. The electrical part attachment portions referred to in this disclosure may be attachment portions to which any electric part, for example, a fuse, a connector, a relay, or a short pin, is attached.

According to embodiments that incorporate a second aspect of the invention, the electrical connection box according to the first aspect above is configured in such a manner that a support surface that supports the additional bus bar in the case is different from a support surface that supports the permanent bus bar.

When configured in this manner, because the additional bus bar and the permanent bus bar are provided in different layers, the additional bus bar can be distinguished from the permanent bus bar with ease, which can facilitate the assembly process.

According to embodiments that incorporate a third aspect of the invention, the electrical connection box of the second aspect above is configured in such a manner that: the case is provided with a containing recessed portion that opens in the support surface that supports the permanent bus bar; the support surface that supports the additional bus bar is formed of a bottom surface of the containing recessed portion; an additional insulating plate is fit in the containing recessed portion in a removable manner; and the additional insulating plate is supported by a permanent insulating plate that supports the permanent bus bar.

When configured in this manner, by supporting the additional bus bar on the bottom surface of the containing recessed portion and fitting the additional insulating plate in the containing recessed portion, the additional bus bar can be supported by the additional insulating plate. It is possible that the additional insulating plate may be supported by the permanent insulating plate either directly or via the permanent bus bar supported by the permanent insulating plate. It is also possible to contain the additional insulating plate alone in the containing recessed portion in a case where no additional bus bar is used. For example, the permanent insulating plate and the permanent bus bar may be prevented from going inside the containing recessed portion by fitting the additional insulating plate fully into the containing recessed portion.

According to embodiments that incorporate a fourth aspect of the invention, the electrical connection box according to the third aspect above is configured in such a manner that the containing recessed portion is provided with a supporting protrusion protruding from the support surface that supports the additional bus bar to a same plane as the plane of the support surface that supports the permanent bus bar.

When configured in this manner, even when the permanent bus bar is provided above the containing recessed portion, the permanent bus bar can be supported by the supporting protrusion. It thus becomes possible to provide the permanent bus bar in a stable manner by preventing the permanent bus bar from going inside the containing recessed portion.

According to embodiments that incorporate a fifth aspect of the invention, the electrical connection box according to any one of the first through fourth aspects above is configured in such a manner that the permanent bus bar is provided with a terminal portion disposed in the additional part attachment portion.

When configured in this manner, an additional circuit of the additional attachment portion can be formed using the permanent bus bar. It thus becomes possible to enhance space efficiency and reduce the number of components by effectively using a conduction path formed of the permanent bus bar.

According to embodiments that incorporate a sixth aspect of the invention, the electrical connection box according to any one of the first through fifth aspects above is configured in such a manner that: the additional part attachment portion includes a short pin attachment portion and a plurality of fuse attachment portions; the additional bus bar includes a plurality of terminal portions and one of the terminal portions is disposed in the short pin attachment portion; and other of the terminal portions are disposed in the respective fuse attachment portions.

When configured in this manner, it becomes possible to form an additional part attachment portion branching from the short pin attachment portion to a plurality of the fuse attachment portions. By selecting whether the short pin is attached to the short pin attachment portion or not, it becomes possible to set conduction or non-conduction to a plurality of the fuse attachment portions at a time.

According to embodiments that incorporate a seventh aspect of the invention, the electrical connection box according to the sixth aspect above is configured in such a manner that: the additional part attachment portion further includes a connector attachment portion; the terminal portion of the additional bus bar comprises pairs of terminal portions; one terminal portion of each pair is disposed in a respective one of the fuse attachment portions; and the other terminal portion of each pair is disposed in the connector attachment portion.

When configured in this manner, the fuse attachment portions and the connector attachment portion are electrically connected by the additional bus bar. It thus becomes possible to feed a connector attached to the connector portion via fuses attached to the fuse attachment portions while preventing an excessive current.

According to at least some embodiments of the invention, the additional part attachment portion is preliminarily provided to the case and the additional bus bar is combined with the additional part attachment portion in a removable manner. Owing to this configuration, in a case in which it becomes necessary to add an electrical part, by combining the additional bus bar with the additional part attachment portion, the electrical part can be attached to the additional part attachment portion without changing a shape of the case or the bus bar. The electrical connection box configuration therefore becomes adaptable to an addition of an electrical part without changing a die used to mold the case or the bus bar. Hence, the electrical connection box becomes more cost efficient by avoiding an increase in cost and man-hours caused by changing the die.

BRIEF DESCRIPTION OF THE DRAWINGS

Exemplary embodiments will be described below with reference to the drawings, in which like numerals represent like parts and in which.

DETAILED DESCRIPTION OF EMBODIMENTS

Hereinafter, an embodiment of the invention will be described with reference to the drawings.

Figure 1:
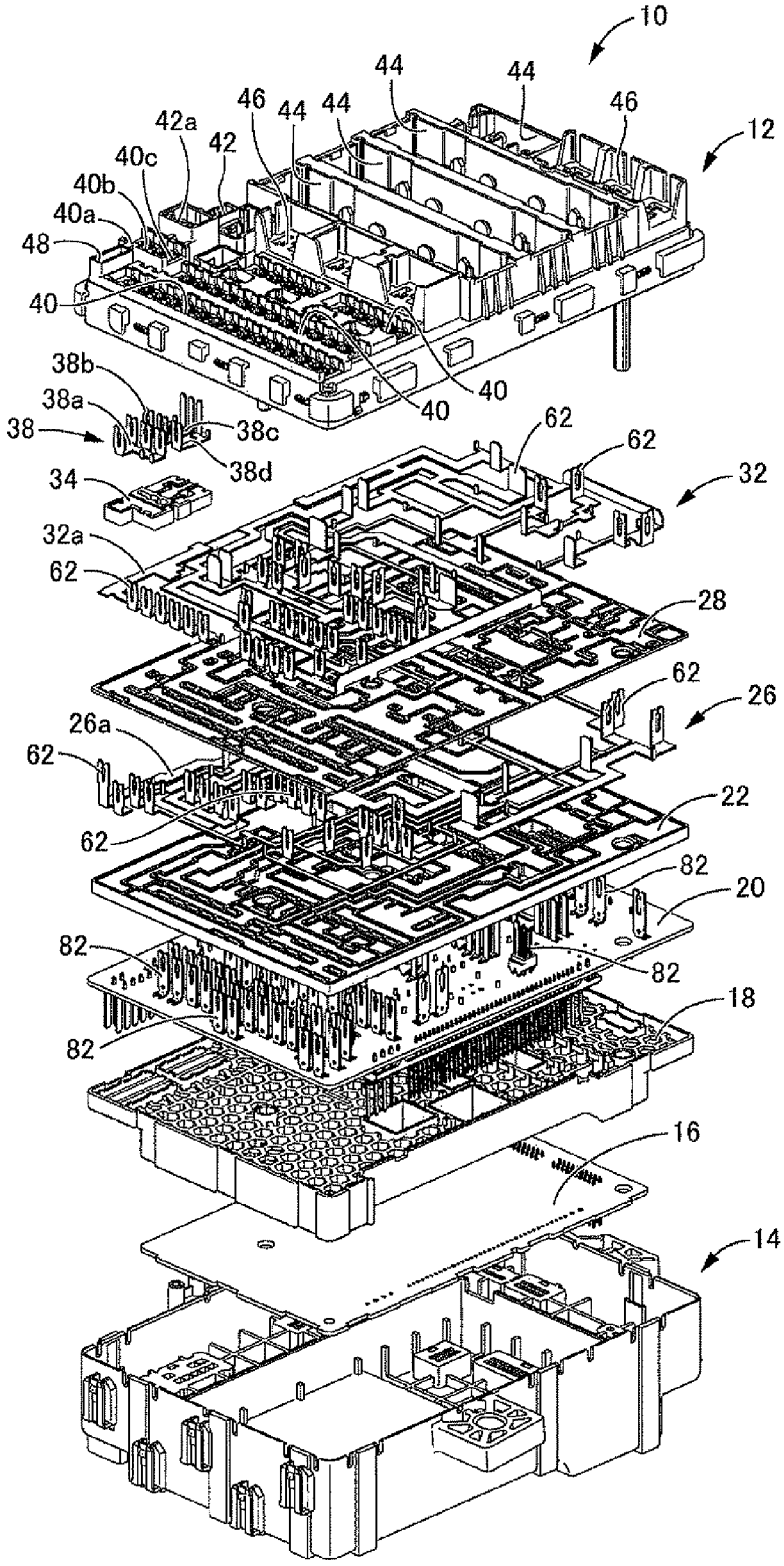
FIG. 1 is an exploded perspective view of an electrical connection box according to an embodiment of the invention.
Figure 2:
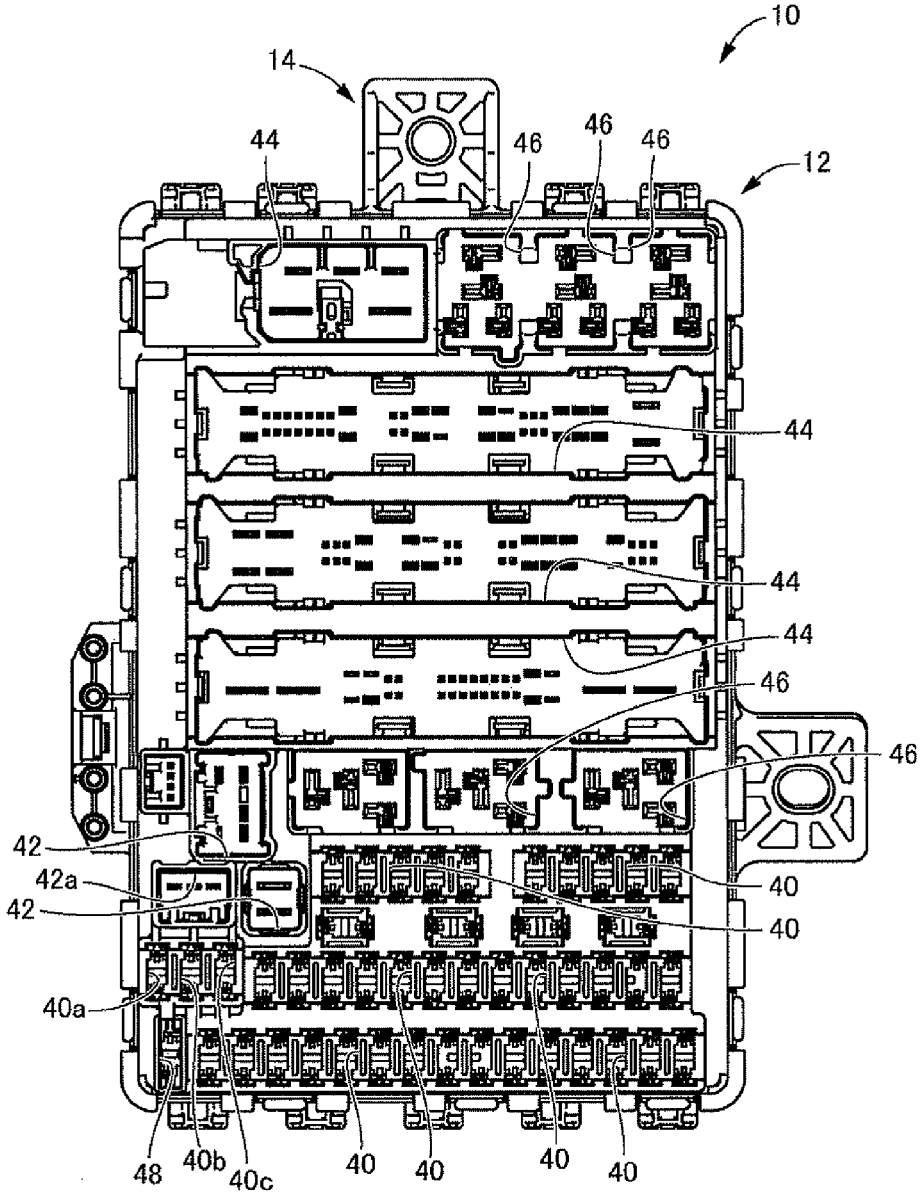
FIG. 2 is a top view of the electrical connection box shown in FIG. 1.

FIG. 1 and FIG. 2 show an electrical connection box 10 according to an embodiment of the invention. As is shown in FIG. 1, the electrical connection box 10 is of a structure containing, between an upper case 12 and a lower case 14, a first printed-circuit board 16, a spacer 18, a second printed-circuit board 20, a first insulating plate 22 as a permanent insulating plate, a first bus bar 26 as a permanent bus bar, a second insulating plate 28 as a permanent insulating plate, a second bus bar 32 as a permanent bus bar, a third insulating plate 34 as an additional insulating plate, and a third bus bar 38 as an additional bus bar arranged sequentially in this order from the side of the lower case 14.

Figure 3:
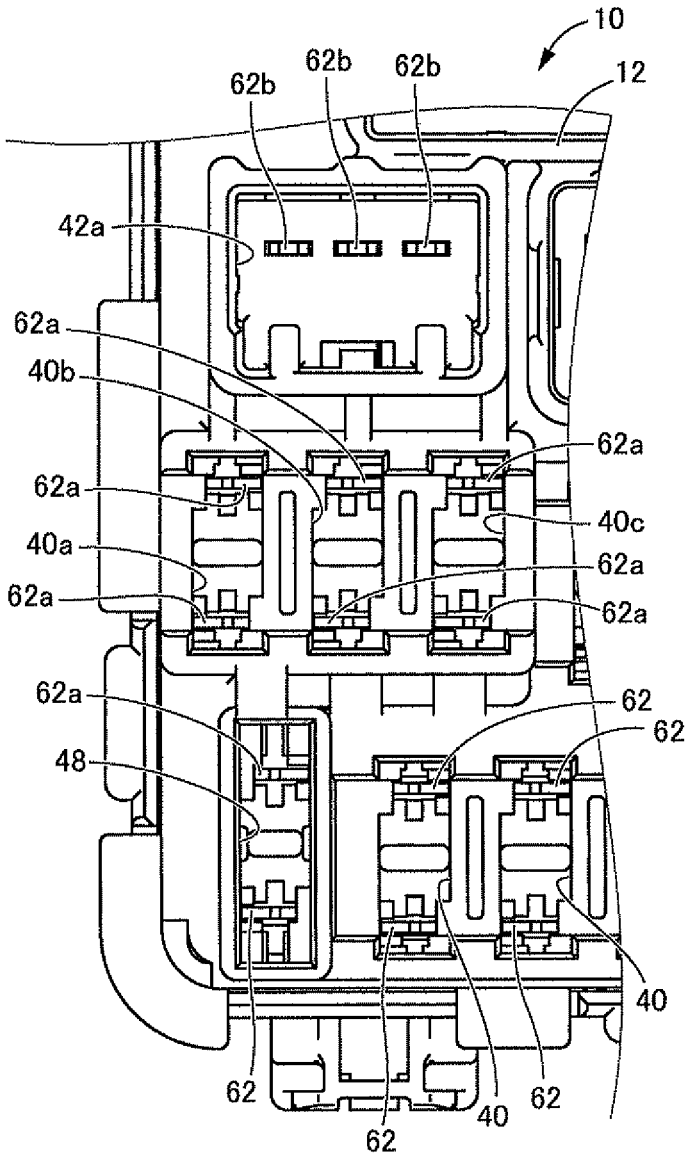
FIG. 3 is a top view of a major portion of the electrical connection box shown in FIG. 1.

As is shown in FIG. 2, the upper case 12 is provided with a plurality of fuse attachment portions 40, connector attachment portions 42, lever connector attachment portions 44, and relay attachment portions 46 as electrical part attachment portions. All of these attachment portions 40, 42, 44, and 46 are defined as permanent part attachment portions. Further, as is shown in an enlarged view in FIG. 3, the upper case 12 is provided with a short pin attachment portion 48, fuse attachment portions 40*a*, 40*b*, and 40*c*, and a connector attachment portion 42*a* as electrical part attachment portions. All of these attachment portions 48, 40*a* through 40*c*, and 42*a* are defined as additional part attachment portions. It should be noted that the fuse attachment portions 40*a* through 40*c* are provided side-by-side between the short pin attachment portion 48 and the connector attachment portion 42*a*.

Figure 4:
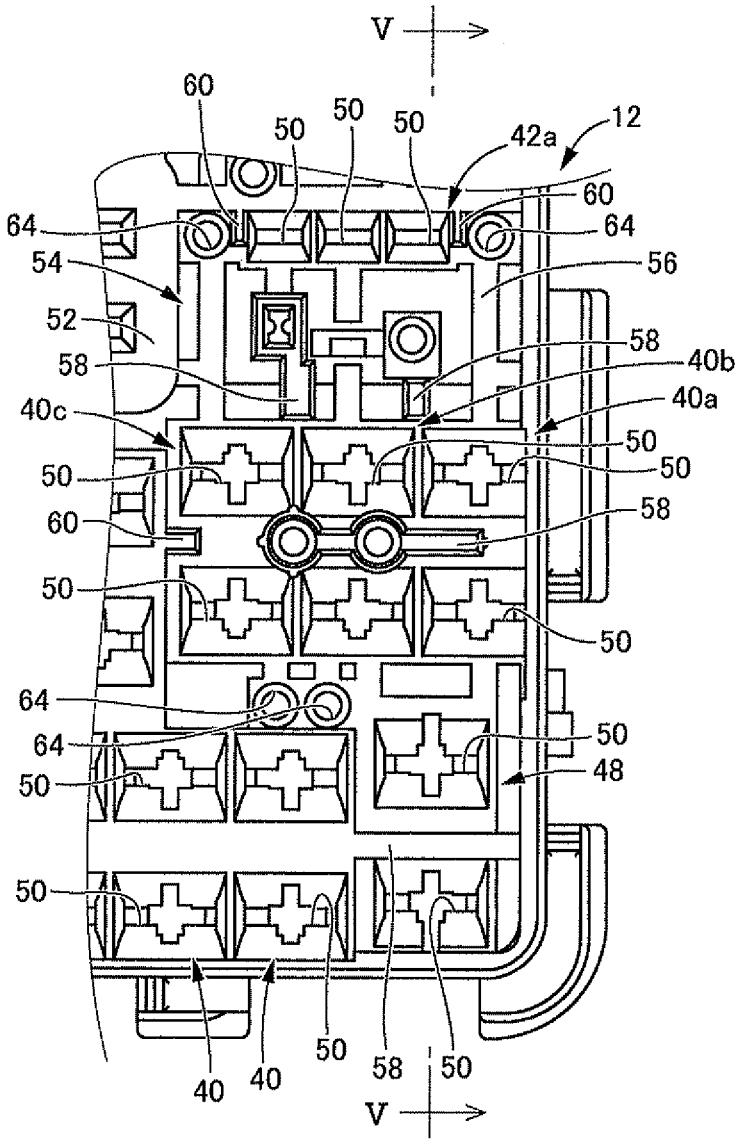
FIG. 4 is a bottom view of an upper case in the major portion shown in FIG. 3.
Figure 5:
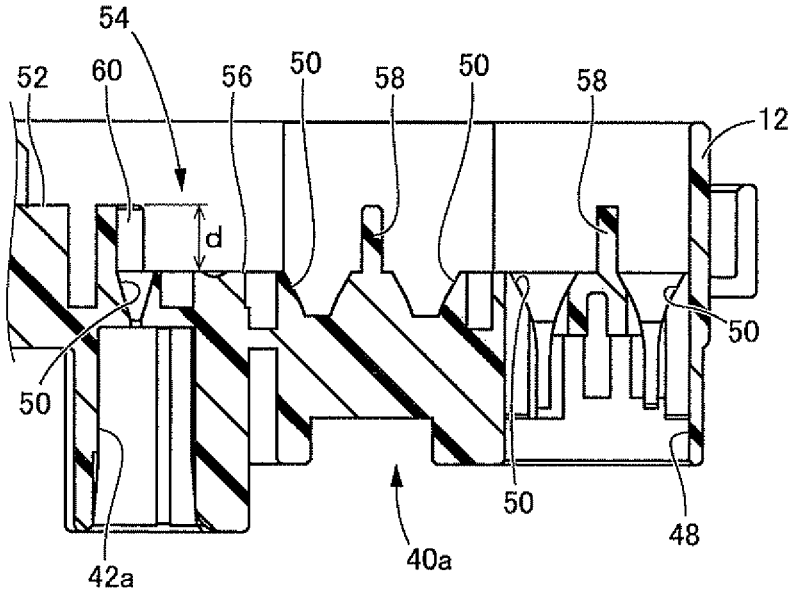
FIG. 5 is a cross section taken on V-V of FIG. 4.

As shown in FIGS. 4 and 5, the attachment portions 40, 42, 44, 46, and 48 each are provided with terminal insertion holes 50 penetrating through the upper case 12. As in the related art, the fuse attachment portions 40 and the short pin attachment portion 48 each are provided with a pair of the terminal insertion holes 50 and 50. Also, the connector attachment portion 42*a* is provided with three terminal insertion holes 50, 50, and 50. Note that in FIG. 5, the upper case 12 is shown inverted from its orientation shown in FIG. 1.

An inner surface 52 of the upper case 12 is in a single plane and the inner surface 52 forms a support surface that supports the permanent bus bars. A containing recessed portion 54 in a concave shape that opens in the inner surface 52 is formed next to the fuse attachment portions 40*a* through 40*c*, the connector attachment portion 42*a*, and the short pin attachment portion 48, which are additional part attachment portions at the side of the inner surface 52. Accordingly, a bottom surface 56 of the containing recessed portion 54 is in a plane that is different from that of the inner surface 52, and which is situated deeper within the upper case 12 (that is, more toward the lower side of FIG. 5) than the inner surface 52. The bottom surface 56 forms a support surface that supports an additional bus bar. The containing recessed portion 54 is provided with a plurality of supporting protrusions 58 protruding from the bottom surface 56 toward the plane of the inner surface 52. Protrusion tip ends of the respective supporting protrusions 58 are in the same plane as the inner surface 52. Further, at appropriate positions on the inner peripheral surface, the containing recessed portion 54 is provided with a plurality of guiding ribs 60 protruding sideways into the containing recessed portion 54 and extending from the plane of the bottom surface 56 to the plane of the inner surface 52.

Figure 6:
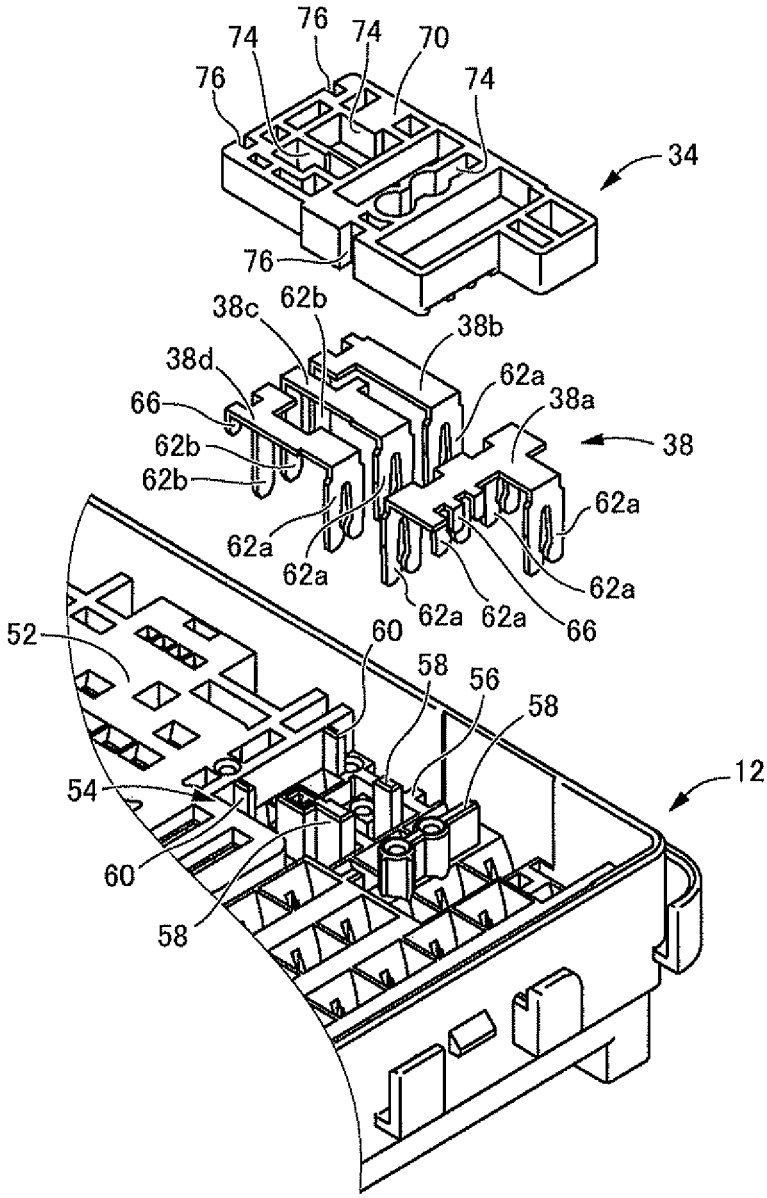
FIG. 6 is a view used to describe a manner in which an additional bus bar and an additional insulating plate are combined with the upper case.

As shown in FIG. 6, the containing recessed portion 54 contains therein the third bus bar 38 and the third insulating plate 34. The third bus bar 38 includes four bus bars 38*a* through 38*d*. The bus bar 38*a* is of a shape in which one terminal portion 62*a* is branched to three terminal portions 62*a*. The bus bars 38*b*, 38*c*, and 38*d* each are of a shape in which terminal portions 62*a* and 62*b* are provided pairwise at the respective ends of the bus bars. The terminal portion 62*a* is of a so-called tuning fork shape including a pair of insulation displacement blades that pinch a plate-like terminal of an unillustrated fuse or short pin. The terminal portion 62*b* is of a plate shape to be inserted into a female terminal of an unillustrated connector. Hereinafter, these terminal portions 62*a* and 62*b* are collectively referred to as the terminal portions 62 unless a need of discrimination arises. Also, as in the related art, the bus bars 38*a* through 38*d* each are provided with a locking protrusion 66 at an appropriate position as the need arises. The locking protrusions 66 are inserted into locking holes 64 opened in the bottom surface 56 of the containing recessed portion 54 and thereby position the third bus bar 38.

Figure 7:
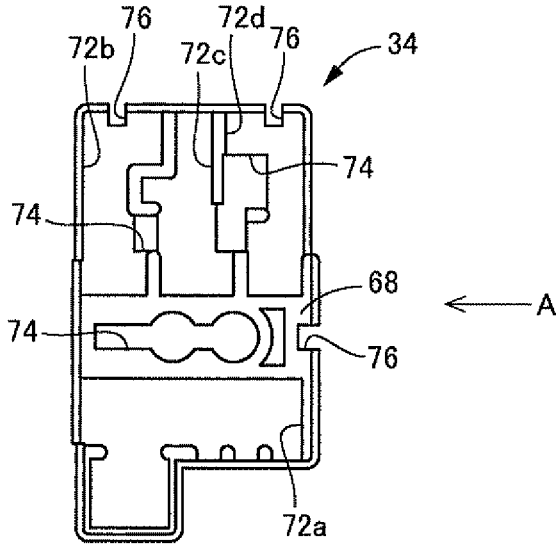
FIG. 7 is a bottom view of the additional insulating plate.
Figure 8:
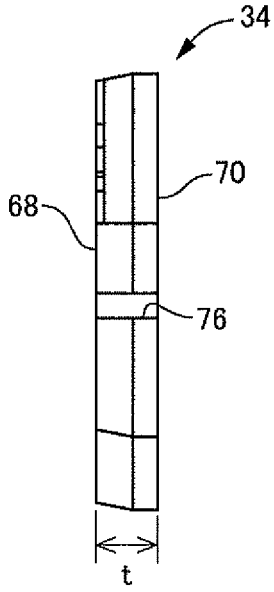
FIG. 8 is a view of the additional insulating plate when viewed from the direction indicated by an arrow A of FIG. 7.

As shown in FIGS. 7 and 8, the third insulating plate 34 is made of non-conducting synthetic resin and has a plate shape substantially the same as an opening shape of the containing recessed portion 54 above the inner surface 52. A thickness dimension of the third insulating plate 34, t, is made substantially equal to a spacing distance d (see FIG. 5) between the inner surface 52 of the upper case 12 and the bottom surface 56, which is given as a depth dimension of the containing recessed portion 54. As shown in FIG. 8, when viewed from one side by way of example, the third insulating plate 34 is formed in such a manner that a plane shape of a top surface 68, which faces forward in an insertion direction into the containing recessed portion 54, becomes slightly smaller than that of a bottom surface 70 and is therefore of substantially a trapezoidal shape with a length of the top surface 68 being slightly shorter than a length of the bottom surface 70 when viewed from any side.

The top surface 68 of the third insulating plate 34 is provided with mounting recesses 72*a* through 72*d* recessed to a depth corresponding to a thickness of the bus bars 38*a* through 38*d* in shapes corresponding to plane shapes of the bus bars 38*a* through 38*d*, respectively. Further, the third insulating plate 34 is provided with evacuation holes 74 penetrating through the third insulating plate 34 at positions superimposed on the respective supporting protrusions 58 of the containing recessed portion 54 in a shape substantially similar to and slightly larger than a shape of the supporting protrusions 58. Furthermore, the third insulating plate 34 is provided with positioning grooves 76 extending in a thickness direction of the third insulating plate 34 (the left-right direction of FIG. 8) on the outer peripheral surface at positions corresponding to the respective positioning ribs 60 of the containing recessed portion 54. It is preferable to form the third insulating plate 34 in a color different from that of the upper case 12. When configured in this manner, visibility of the third insulating plate 34 can be enhanced, which makes it possible to determine with ease whether the third insulating plate 34 is contained in the containing recessed portion 54.

Figure 9:
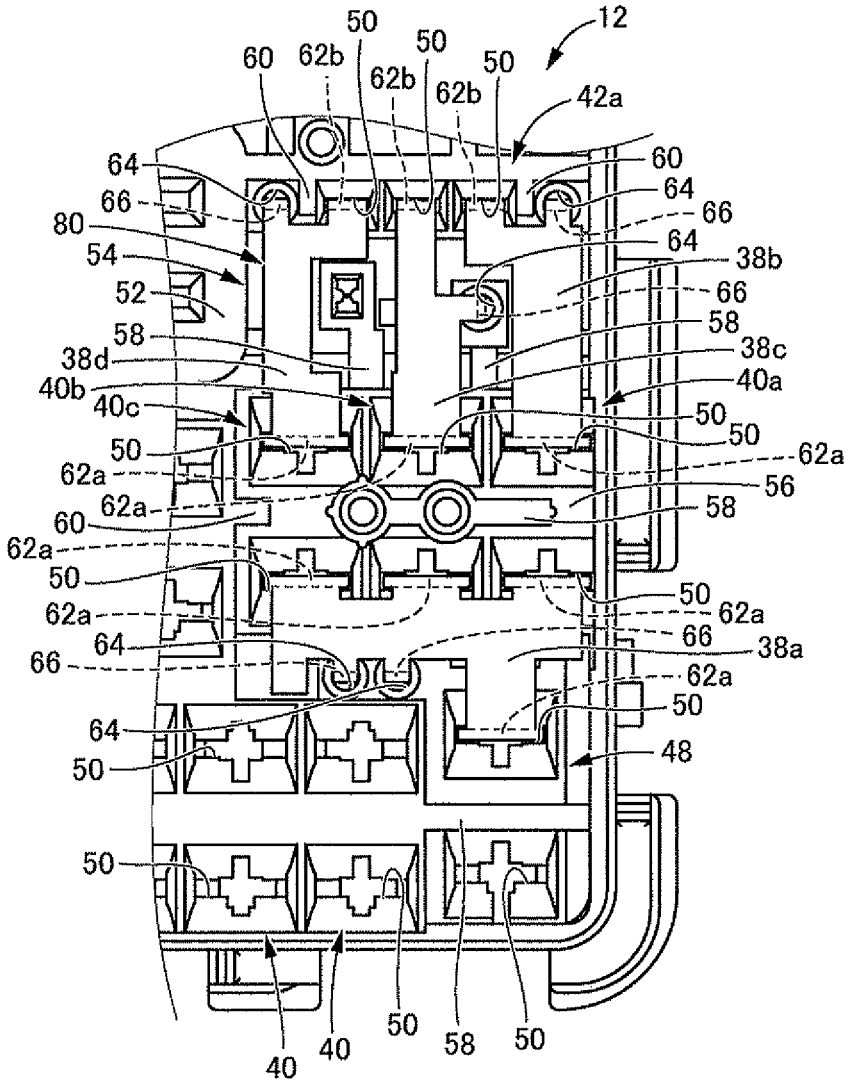
FIG. 9 is a bottom view of the major portion shown in FIG. 4 in a state in which the additional bus bar is combined with the upper case.

Also, as shown in FIG. 6, the bus bars 38*a* through 38*d* are inserted into the containing recessed portion 54 and superimposed on the bottom surface 56 of the containing recessed portion 54. Consequently, as shown in FIG. 9, one of the terminal portions 62*a* of the bus bar 38*a* is inserted into one terminal insertion hole 50 of the short pin attachment portion 48 and disposed in the short pin attachment portion 48 while the remaining three terminal portions 62*a*, 62*a*, and 62*a* are inserted into the terminal insertion holes 50, 50, and 50, with one of these terminal insertion holes 50 being in each of the fuse attachment portions 40*a*, 40*b*, and 40*c*, and disposed in the respective fuse attachment portions 40*a*, 40*b*, and 40*c*. Also, one terminal portion 62*a* of the bus bar 38*b* is inserted into the other terminal insertion hole 50 of the fuse attachment portion 40*a* and disposed in the fuse attachment portion 40*a*, while the other terminal portion 62*b* is inserted into one of the three terminal insertion holes 50 in the connector attachment portion 42*a* and disposed in the connector attachment portion 42*a*. Likewise, the respective terminal portions 62*a* and 62*a* of the bus bars 38*c* and 38*d* are disposed in the fuse attachment portions 40*b* and 40*c*, respectively, and the other terminal portions 62*b* and 62*b* are disposed in the connector attachment portion 42*a*. Accordingly, the bus bar 38*a* bridges between the short pin attachment portion 48 and the respective fuse attachment portions 40*a*, 40*b*, and 40*c* to electrically connect the former and the latter. Meanwhile, the respective bus bars 38*b*, 38*c*, and 38*d* bridge between the respective fuse attachment portions 40*a*, 40*b*, and 40*c* and the connector attachment portion 42*a* to electrically connect the former and the latter. In this manner, an additional circuit 80 including the bus bar 38*a*, 38*b*, 38*c*, and 38*d* is formed and the additional circuit 80 forms conducting paths among the short pin attachment portion 48, the respective fuse attachment portions 40*a*, 40*b*, and 40*c*, and the connector attachment portion 42*a* as additional part attachment portions.

Figure 10:
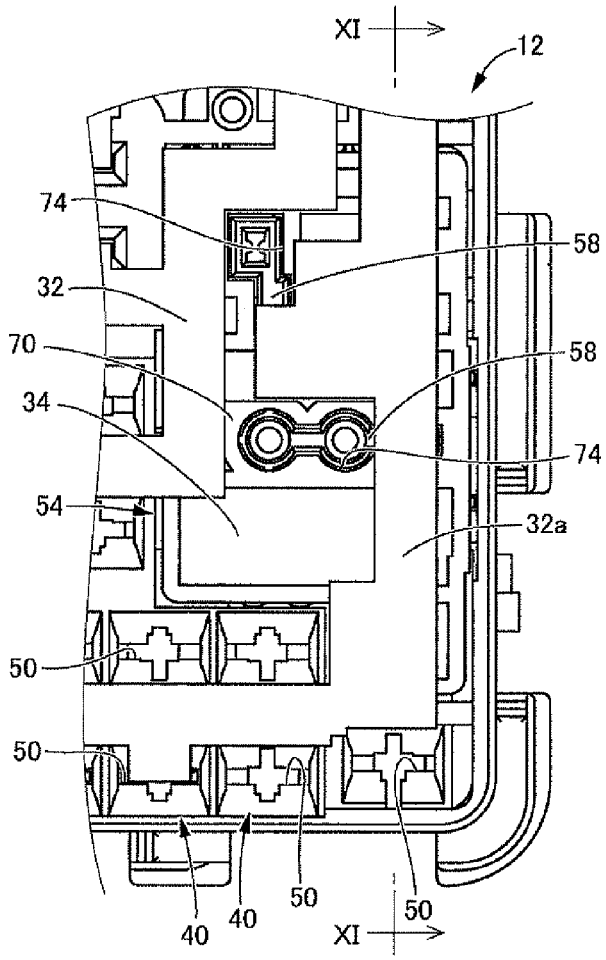
FIG. 10 is a bottom view of the major portion shown in FIG. 9 in a state in which the additional insulating plate and a permanent bus bar are combined with the upper case.
Figure 11:
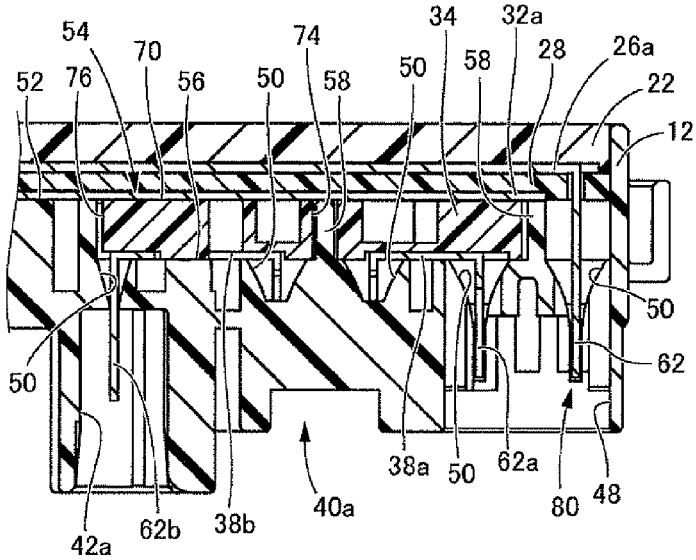
FIG. 11 is a cross section taken on line XI-XI of FIG. 10 showing of the major portion shown in FIG. 10 in a state in which the permanent bus bar and a permanent insulating plate are further combined with the upper case.

As shown in FIG. 6, the third insulating plate 34 is fit in the containing recessed portion 54. The third insulating plate 34 is fit in the containing recessed portion 54 with the top surface 68 facing into the upper case 12, and the bottom surface 70 facing outward from the upper case 12. (Note that because the upper case 12 in FIG. 6 is shown inverted from its assembled orientation shown in FIG. 1, the bottom surface 70 is shown on top in FIG. 6.) Because the top surface 68 is made slightly smaller than the bottom surface 70, the third insulating plate 34 is fit into the containing recessed portion 54 with ease. Also, as shown in FIGS. 10 and 11, the third insulating plate 34 is positioned within the containing recessed portion 54 as the supporting protrusions 58 of the containing recessed portion 54 are inserted into the evacuation holes 74 in the third insulating plate 34 while the guiding ribs 60 are inserted into the guiding groove 76. Consequently, the third insulating plate 34 is superimposed on the bus bars 38*a* through 38*d*. The bus bars 38*a* through 38*d* are positioned on the third insulating plate 34 as they are mounted, respectively, in the mounting recesses 72*a* through 72*d* (see FIG. 7) provided on the top surface 68 of the third insulating plate 34. In a state in which the third insulating plate 34 is contained in the containing recessed portion 54, the bottom surface 70 of the third insulating plate 34 is positioned substantially in the same plane as the inner surface 52 of the upper case 12.

As shown in FIG. 1, the first printed-circuit board 16, the spacer 18, the second printed-circuit board 20, the first insulating plate 22, the first bus bar 26, the second insulating plate 28, and the second bus bar 32 are arranged sequentially and contained in the lower case 14, on which the upper case 12 is superimposed. When configured in this manner, the terminal portions 62 provided to the first bus bar 26 and the second bus bar 32 and board terminals 82 provided to the first printed-circuit board 16 in a protruding condition are inserted into the terminal insertion holes 50 in the fuse attachment portions 40, the connector attachment portions 42, the lever connector attachment portions 44, and the relay attachment portions 46 provided to the upper case 12 as the permanent part attachment portions and disposed in the respective attachment portions 40, 42 44, and 46.

As shown in FIGS. 10 and 11, the second bus bar 32 is superimposed on the inner surface 52 of the upper case 12. In this embodiment, a bus bar 32*a* forming the second bus bar 32 is provided above the containing recessed portion 54 and supported by the third insulating plate 34 and the supporting protrusions 58. Also, as shown in FIG. 11, the second bus bar 32 is supported by the second insulating plate 28 and the third insulating plate 34 is supported by the second insulating plate 28. Further, as shown in FIG. 11, the terminal portion 62 provided to a bus bar 26*a* forming the first bus bar 26 is inserted into the terminal insertion hole 50 in the short pin attachment portion 48 on the side where the bus bar 38*a* is not inserted, and disposed in the short pin attachment portion 48. In this manner, the additional circuit 80 including the first bus bar 26*a* as a permanent bus bar is formed in this embodiment.

As has been described, the additional circuit 80 that branches from the short pin attachment portion 48 to the respective fuse attachment portions 40*a*, 40*b* and 40*c* while being connected from the fuse attachment portions 40*a*, 40*b*, and 40*c*, respectively, to the terminal portions 62*b*, 62*b*, and 62*b* in the connector attachment portion 42*a* is formed. As unillustrated short pin, fuses, and connector as electric parts are attached to the short pin attachment portion 48, the respective fuse attachment portions 40*a*, 40*b*, and 40*c*, and the connector attachment portion 42*a*, power supplied from the terminal portion 62 of the first bus bar 26*a* disposed in the short pin attachment portion 48 is distributed to the fuses attached to the respective fuse attachment portions 40*a*, 40*b*, and 40*c* by way of the short pin attached to the short pin attachment portion 48. Meanwhile, the power can be extracted to the outside of the electrical connection box 10 from the connector attached to the connector attachment portion 42*a* by way of the respective fuses. By selecting whether the short pin is attached to the short pin attachment portion 48 or not, it becomes possible to set conduction states to the respective fuse attachment portions 40*a*, 40*b*, and 40*e* collectively.

According to the electrical connection box 10 having the structure of this embodiment, the short pin attachment portion 48, the fuse attachment portions 40*a*, 40*b*, and 40*c*, and the connector attachment portion 42*a* as additional part attachment portions are preliminarily provided to the upper case 12. In a case in which it becomes necessary to add an electrical part, by allowing the third bus bar 38 and the third insulating plate 34 to be contained in the containing recessed portion 54 of the upper case 12, the additional circuit 80 including the third bus bar 38 and serving as conduction paths to the attachment portions 48, 40*a* through 40*c*, and 42*a* is formed. A short pin, fuses, and a connector can be therefore attached to the attachment portions 48, 40*a* through 40*c*, and 42*a*, respectively. The configuration of the electrical connection box 10 thus becomes adaptable to an addition of an electrical part without changing a die used to form the upper case 12, the first bus bar 26, and the second bus bar 32.

Particularly in this embodiment, the third bus bar 38 is mounted on the third insulating plate 34 and the third insulating plate 34 is supported by the second insulating plate 28. Owing to this configuration, when a short pin, fuses, and a connector are connected to the terminal portions 62 of the third bus bar 38, it becomes possible to support the third bus bar 38 on the third insulating plate 34. Also, the third bus bar 38 and the third insulating plate 34 are contained in the containing recessed portion 54 and provided in a layer different from a layer of the second bus bar 32 and the first bus bar 26, which are permanent bus bars. It thus becomes possible to determine with ease whether the third bus bar 38 is combined with the upper case 12 or not. Further, by fitting the third insulating plate 34 in the containing recessed portion 54 to allow the bottom surface 70 of the third insulating plate 34 and the inner surface 52 of the upper case 12 to be positioned in the same plane, the second bus bar 32 can be provided in a stable manner by preventing the second bus bar 32 superimposed on the inner surface 52 from going inside the containing recessed portion 54. In addition, because a terminal portion 62 provided to the first bus bar 26*a*, which is a permanent bus bar, is disposed in the short pin attachment portion 48 and forms an input terminal to a short pin to be attached to the short pin attachment portion 48, it becomes possible to form a power feeding path to the short pin at a low cost with high space efficiency using fewer components by utilizing a permanent bus bar.

Figure 12:
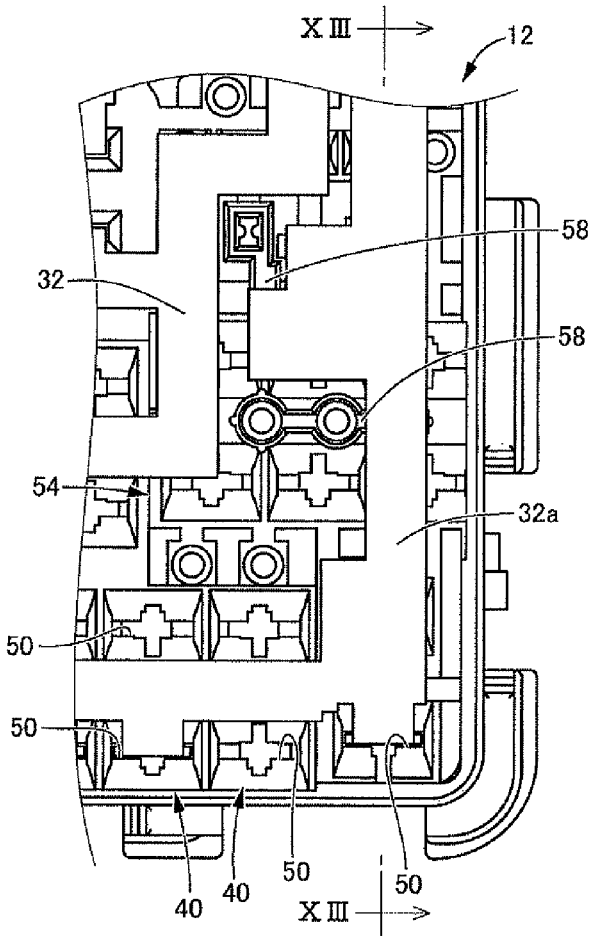
FIG. 12 is a bottom view of the major portion shown in FIG. 10 in a state in which neither the additional bus bar nor the additional insulting plate is combined with the upper case.
Figure 13:
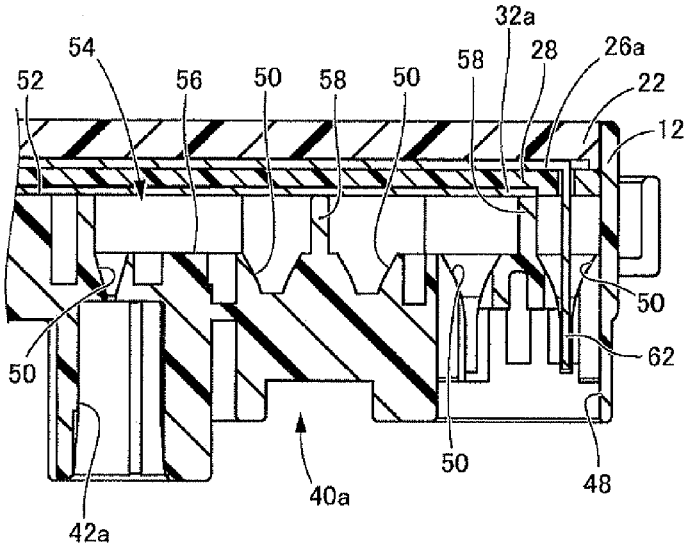
FIG. 13 is a cross section taken on XIII-XIII of FIG. 12 showing the major portion shown in FIG. 12 in a state in which the permanent bus bar and the permanent insulating plate are further combined with the upper case.

In a case in which it is not necessary to add an electrical part, as shown in FIGS. 12 and 13, the electrical connection box 10 may be assembled without the third bus bar 38 and the third insulating plate 34 being present in the upper case 12. It thus becomes possible to reduce waste of a bus bar. Particularly in this embodiment, the second bus bar 32 can be provided in a stable manner even when the third bus bar 38 and the third insulating plate 34 are removed, because, as shown in FIG. 13, the bus bar 32*a* forming the second bus bar 32 and provided above the containing recessed portion 54 is supported by the supporting protrusions 58 and inhibited from going inside the containing recessed portion 54.

While one embodiment of the invention has been described, the invention is not limited to specific descriptions above. Various modifications are possible within the spirit and scope of the invention. For example, an additional insulating plate is not necessarily required. However, a permanent bus bar may be inhibited from going inside the containing recessed portion by fitting an additional insulating plate in the containing recessed portion even when an additional bus bar is not used.

As another example, the containing recessed portion in the embodiment above is not necessarily required, either. For example, an additional bus bar may be supported by a permanent insulating plate that supports a permanent bus bar by providing the additional bus bar in the same layer as the permanent bus bar.

What is claimed is:

1. An electrical connection box, comprising:

a case;

electrical part attachment portions provided to the case; and bus bars contained in the case, each bus bar having a terminal portion disposed in a respective one of the electrical part attachment portions, wherein:

the electrical part attachment portions comprise a permanent part attachment portion and an additional part attachment portion;

the bus bars comprise permanent bus bars and an additional bus bar;

the terminal portions of the permanent bus bar are disposed in the permanent part attachment portion, and the terminal portion of the additional bus bar is disposed in the additional part attachment portion by allowing the additional bus bar to be contained in the case in a removable manner; and the permanent bus bars form a complete electrical circuit when an electrical part is installed in the permanent part attachment portion, and the additional bus bar forms an additional circuit when an electrical part is installed in the additional part attachment portion.

2. The electrical connection box according to claim 1, wherein:

the permanent bus bar is provided with a terminal portion disposed in the additional part attachment portion.

3. The electrical connection box according to claim 1, wherein:

the additional part attachment portion includes a short pin attachment portion and a plurality of fuse attachment portions;

the additional bus bar includes a plurality of terminal portions and one of the terminal portions is disposed in the short pin attachment portion; and other of the terminal portions are disposed in the respective fuse attachment portions.

4. The electrical connection box according to claim 3, wherein:

the additional part attachment portion further includes a connector attachment portion;

the terminal portion of the additional bus bar comprises pairs of the terminal portions;

one terminal portion of each pair is disposed in a respective one of the fuse attachment portions; and the other terminal portion of each pair is disposed in the connector attachment portion.

5. The electrical connection box according to claim 1, wherein:

a support surface of the case that supports the additional bus bar is in a different plane from a plane of a support surface that supports the permanent bus bar.

6. The electrical connection box according to claim 5, wherein:

the case is provided with a containing recessed portion that opens in the support surface that supports the permanent bus bar;

the support surface that supports the additional bus bar is formed of a bottom surface of the containing recessed portion;

an additional insulating plate fits in the containing recessed portion in a removable manner; and the additional insulating plate is supported by a permanent insulating plate that supports the permanent bus bar.

7. The electrical connection box according to claim 6, wherein:

the containing recessed portion is provided with a supporting protrusion protruding from the support surface that supports the additional bus bar to a same plane as a plane of the support surface that supports the permanent bus bar.

* * * * *